United States Patent [19]

Naylor

[11] Patent Number: 4,583,082

[45] Date of Patent: Apr. 15, 1986

[54] OPTICAL DOOR INTERLOCK

[75] Inventor: Mark C. Naylor, Reno, Nev.

[73] Assignee: IGT, Reno, Nev.

[21] Appl. No.: 502,872

[22] Filed: Jun. 9, 1983

[51] Int. Cl.[4] ..... G08B 13/08

[52] U.S. Cl. ..... 340/545; 340/556; 340/600

[58] Field of Search ..... 340/545, 600, 555, 556, 340/557

[56] References Cited

U.S. PATENT DOCUMENTS

| | | | |
|---|---|---|---|
| 3,509,359 | 4/1970 | Embling | 340/556 X |
| 3,924,253 | 12/1975 | Marino | 340/600 |
| 4,074,246 | 2/1978 | Conklin et al. | 340/545 X |
| 4,242,670 | 12/1980 | Smith | 340/600 X |
| 4,262,284 | 4/1981 | Stieff et al. | 340/568 |
| 4,379,289 | 4/1983 | Peek | 340/600 X |
| 4,458,146 | 7/1984 | Reiner et al. | 340/556 X |
| 4,465,998 | 8/1984 | Durand | 340/557 |

FOREIGN PATENT DOCUMENTS

| | | | |
|---|---|---|---|
| 2805766 | 8/1978 | Fed. Rep. of Germany | 340/545 |
| 7713863 | 7/1979 | Sweden | 340/545 |
| 2013332 | 8/1979 | United Kingdom | 340/545 |

*Primary Examiner*—James L. Rowland
*Assistant Examiner*—Brian R. Tumm
*Attorney, Agent, or Firm*—Townsend & Townsend

[57] ABSTRACT

Method and apparatus for monitoring the opening and closing of a door and for detecting unauthorized opening of the door. The apparatus comprises a light emitting diode and a sensor mounted with respect to the door so as to be in optical communication with one another when the door is closed. A microprocessor monitors and controls the operation of the light emitting diode and sensor. When the sensor is receiving light, preliminarily indicating that the door is closed, the microprocessor verifies that the light emitting diode and sensor are still in optical communication with one another. In the preferred embodiment verification is achieved by causing the light emitting diode to emit a predetermined sequence of pulses and monitoring whether the sensor tracks the predetermined sequence of pulses. An alarm signal is provided when the sensor senses light and the microprocessor determines that the light emitting diode and sensor are not in optical communication with one another.

15 Claims, 2 Drawing Figures

OPTICAL DOOR INTERLOCK

BACKGROUND OF THE INVENTION

The invention relates generally to apparatus for monitoring the opening and closing of a door and is more particularly directed to an apparatus and method for detecting unauthorized opening and closing of a door.

In various coin-operated machines, such as slot machines, video games, pinball machines, and other games of chance, it is necessary to detect and keep track of the various times the door to the coin box and interior of the game cabinet is opened. The reason is two-fold: first, it is desirable to detect and to discourage pilfering from the coin box or tampering with the game mechanism itself to alter the game play; second, particularly with gaming devices which accept wagers, it is necessary to keep track of the door openings to maintain a proper accounting of the financial status of the gaming device. Known gaming devices typically have door interlock switches or the like which register when the door has been opened. Unfortunately, it has proven to be quite easy to defeat most door interlock switches. When the switch is defeated, it is possible to gain access to the coin box or the game mechanism without sounding any alarm and without causing a record to be made of the unauthorized door opening.

SUMMARY OF THE INVENTION

The present invention provides a door interlock method and apparatus for monitoring the opening and closing of a door to a secure game cabinet or the like which cannot be readily defeated by known techniques. Briefly, the door interlock apparatus comprises a radiative emitter, such as a light emitting diode or an infrared emitting diode, and a sensor which are mounted with respect to the door so as to be in optical communication with one another when the door is in closed position. The term "optical communication" as used herein embraces communication by infrared and ultraviolet radiation as well as by radiation in the visible spectrum. In the method of the invention the sensor is interrogated to determine whether it is receiving radiation, and if so, a first signal is provided indicating that fact. In response to the first signal, a determination is made whether the emitter and sensor are still in optical communication with one another. If they are not in optical communication, a second signal is provided to an indicator means, which provides an indication that someone has attempted to tamper with the door.

With this method certain attempts to circumvent the system will be easily detected. For example, if the door is in fact closed, then the sensor will of course be receiving radiation, and a first signal would be provided in accordance with the invention. However, the sensor could also be receiving radiation from a second source in an attempt to foil the system. Therefore, the invention calls for verification that the emitter and sensor are still in optical communication before concluding that the door is closed.

In a further of its aspects, the invention calls for periodically determining over a predetermined duration whether the above first-named signal is being provided. If the signal fails to be provided for the full predetermined duration, then a further signal is provided indicating the door is truly open. According to this aspect of the invention, the optical communication between the emitter and sensor must be interrupted for the full predetermined duration, for example, 100 milliseconds, before the method signals that the door is open.

In a preferred embodiment of the invention, the determination that the sensor and emitter are in optical communication is made by causing the emitter to emit characteristic pulses of light in a predetermined sequence and then monitoring whether those pulses are received by the sensor. In this way, the system cannot be foiled by replacing the emitter with a substitute light source. In another aspect of the invention, the emitter and sensor are operated at different current levels, so that the system cannot be foiled merely by shunting the emitter and sensor together.

In a preferred embodiment the operation and monitoring of the emitter and sensor are controlled by a microprocessor. An exposition is given hereinbelow of a suitable microprocessor control routine for implementing the method.

A further understanding and appreciation of the nature and advantages of the invention can be gained by reference to the remaining portions of the specification and to the attached drawings.

DETAILED DESCRIPTION OF THE PREFERRED EMBODIMENTS

Figure 1:
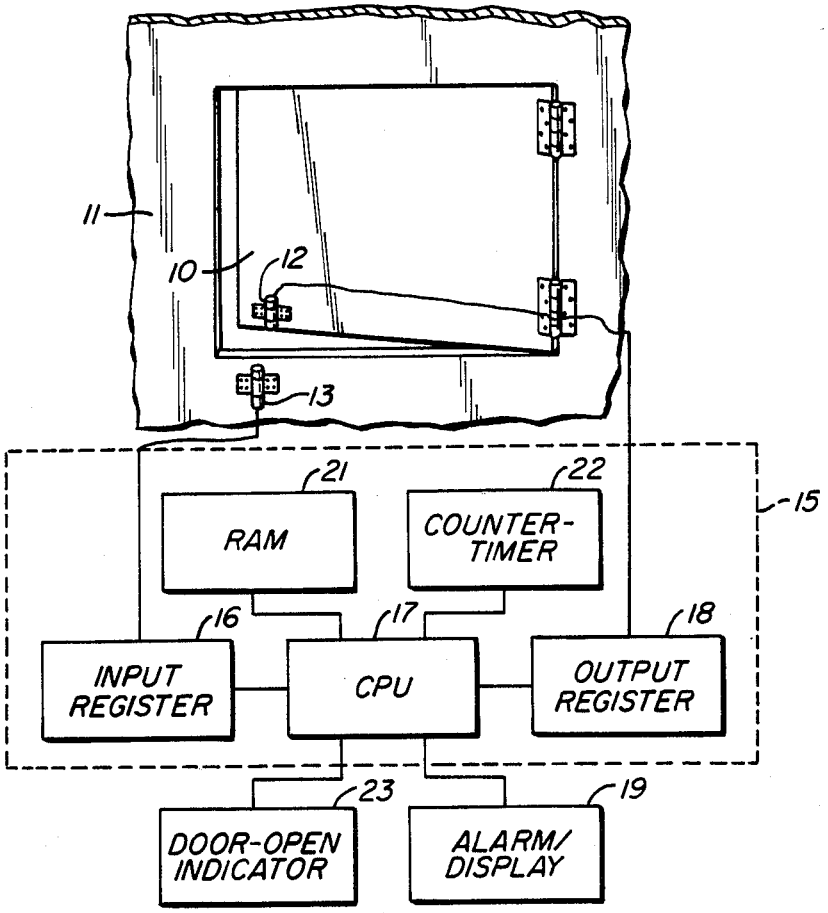
FIG. 1 is a combination block diagram and perspective view of a portion of a cabinet and apparatus for practicing the method of the invention; a portion of an interior wall and cabinet door with sensor and emitter mounted thereon is shown in perspective, and apparatus for controlling the emitter and sensor is shown in the block diagram.

FIG. 1 shows a portion of a door 10 and an interior wall 11 of a game cabinet. A radiative emitter 12 and sensor 13 are mounted in operative association with door 10 so as to communicate with one another when the door is in closed position. The term "operative association" as used herein is taken to mean that emitter 12 and sensor 13 are mounted so as to define an interruptable communication path which is interrupted when door 10 is opened. An emitter and sensor in this configuration will communicate with one another across a gap to close an electrical circuit when door 10 is closed and will cause that circuit to be broken when door 10 is opened. Configured in this manner, the emitter and sensor can be coupled to a suitable indicating circuit to monitor the opening and closing of door 10. However, this simple arrangement is easily foiled to give a false indication of a closed door.

The present invention adds to the above-described configuration a means for interrogating emitter 12 and sensor 13 to verify whether they are indeed in communication with one another, which can only occur when door 10 is closed. According to the invention, the verification function is provided by a first means which has a first state indicating that said sensor is receiving radiation and a second state indicating that it is not; a second means for pulsing emitter 12; a third means which monitors whether the state of the first means tracks the pulsation of emitter 12 and provides an alarm signal when it fails to track the pulsations; and a fourth means providing an indication of unauthorized opening of door 10 in response to the alarm signal.

In the preferred embodiment illustrated in FIG. 1 these means are provided by microprocessor 15, which includes input register 16, central processing unit 17, output register 18, and counter/timer 22. Sensor 13 is connected to input register 16 and provides a signal causing a status bit or flag to be set in input register 16 whenever sensor 13 is receiving radiation. Output register 18 is connected to emitter 12 and provides a signal in response to commands from CPU 17 for energizing the emitter.

As explained more fully hereinbelow, when the status bit is set in input register 16, indicating that sensor 13 is receiving radiation, CPU 17 provides a sequence of commands causing emitter 12 to pulse in a predetermined manner. As used herein, the term "to pulse" means to deenergize emitter 12 for a characteristic period, that is, to cause emitter 12 to blink. If sensor 13 fails to receive the pulsation of emitter 12, that is, if the status bit of input register 16 fails to track the pulse commands of CPU 17, then microprocessor 15 provides an alarm signal indicating that the emitter-sensor configuration has been tampered with. The alarm signal is received by indicator means 19.

The indicator means 19 may be provided by any of several common devices, such as a local or remote auditory alarm or a local or remote display monitor indicating unauthorized opening of the door and unauthorized entry into the cabinet. CPU 17 may also make an entry in a memory device, such as random access memory 21, recording the tampering attempt. Such alarm, display, or memory arrangements are well known to those skilled in the art.

The preferred embodiment also includes means for indicating when door 10 is truly open. As illustrated in FIG. 1, the apparatus further comprises counter/timer 22 included in microprocessor 15 and a second indicator means 23 for indicating that door 10 is open. On command from CPU 17, counter/timer 22 counts down a predetermined time interval when the sensor-status bit is first set in input register 16. If sensor 13 does not change its status during the predetermined time interval, that is, if the sensor-status bit is not cleared from input register 16 during the predetermined time interval, then microprocessor 15 activates indicator means 23 to signal that door 10 is truly open. If sensor 13 does change its status within the predetermined time interval, that is, if the sensor-status bit is cleared from input register 16 within the predetermined time interval, then CPU 17 commands output register 18 to pulse emitter 12 so as to verify whether emitter 12 and sensor 13 are still in optical communication with one another.

In the preferred embodiment radiative emitter 12 is provided by a light emitting diode which is connected directly to an output port of microprocessor 15. Sensor 13 is then provided by a phototransistor connected at its bias side to an input port of microprocessor 15. The phototransistor is operated at a level sufficiently high so as not to respond to ambient light. The light emitting diode is mounted on door 10 so that when the door is closed, the diode will be in close proximity to the phototransistor. In this manner, the light emitting diode communicates with the phototransistor only across a small air gap and can deliver a light signal of sufficient intensity to activate the phototransistor, which is not activated by ambient light levels. While the preferred embodiment illustrated here employs a light emitting diode, other types of radiative emitters can be used in the invention, for example, an infrared emitting diode.

Figure 2:
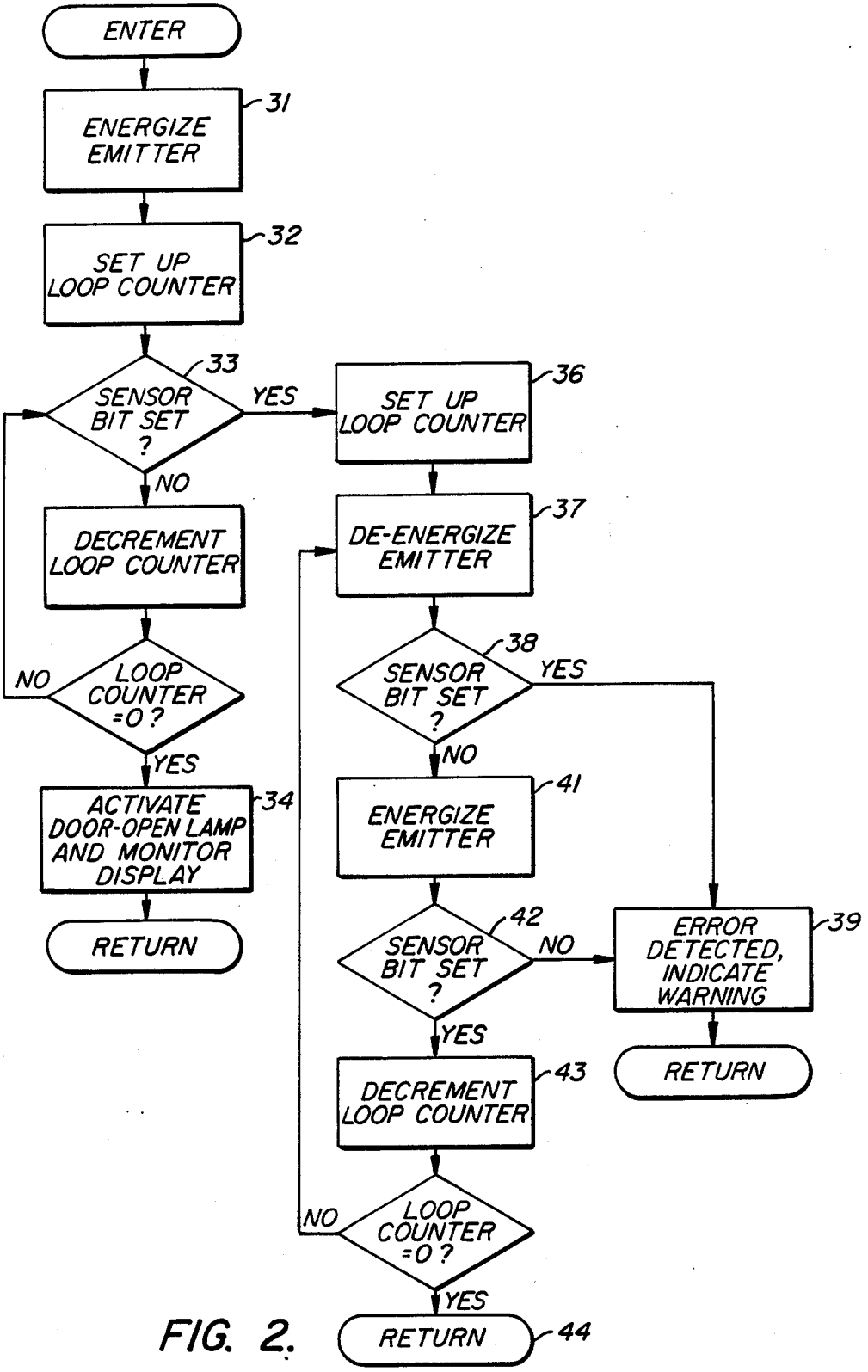
FIG. 2 is a logic flow chart illustrating a microprocessor routine for controlling the emitter and sensor in accordance with the invention.

Having described the general arrangement and function of apparatus for practicing the invention, the control of microprocessor 15 is now described in more detail. FIG. 2 provides a flow chart of a routine for practicing the invention, and Appendix I contains an illustrative assembly-language program. With reference to FIG. 2, upon entry into the routine emitter 12 is activated at block 31 and counter/timer 22 is initialized at block 32. At block 33, CPU 17 checks whether the sensor-status bit has been set. A cleared status bit indicates that sensor 13 is not receiving radiation and provides a preliminary indication that door 10 is open. As described above, however, CPU 17 does not signal indicator means 23 that the door is truly open unless sensor 13 fails to receive any radiation for a continuous, predetermined time interval. Thus, if upon interrogation at block 33 it is found that no sensor-status bit is set, the counter is decremented, the status of the sensor is interrogated again, and so on until the counter has counted down to zero. In the illustrative program of Appendix I the counter is set to count down a predetermined time interval of 100 milliseconds. If the counter reads zero, then at block 34 CPU 17 signals indicator means 23 that the door is open. The CPU command may be used to produce a door-open display on an appropriate monitor and to perform such other commonplace tasks as turning on a lamp within the cabinet.

If at any time before the loop counter 22 counts down to zero the interrogation at block 33 determines that the sensor-status flag has been set, then control shifts to block 36, which initializes the counter again in preparation for a verification loop.

In the verification loop CPU 17 pulses emitter 12 and verifies whether the pulses are tracked by sensor 13. At block 37 CPU 17 causes emitter 12 to be deenergized. CPU 17 then checks the state of the sensor-status bit. If the bit is still set, then CPU 17 concludes that sensor 13 is not tracking the pulsation of emitter 12 and the sensor and emitter are no longer in communication with one another. Upon the occurrence of this condition, CPU 17 provides an alarm signal at block 39 to indicator means 19.

If the status bit has changed its state, so as to track the leading edge of the first pulse from emitter 12, then at block 41 CPU 17 causes the emitter to be energized again. At block 42 CPU 17 checks once again the state of the sensor-status bit to ascertain whether it has tracked the trailing edge of the pulse from emitter 12. If so, the loop counter is decremented at block 43.

Emitter 12 is pulsed in this manner for a predetermined number of pulses as defined by the loop counter. If at any time during the verification loop the sensor-status bit fails to track the leading edge or the trailing edge of any pulse, control will shift to block 39, which provides an alarm signal indicating unauthorized tampering with the door interlock system. If the sensor-status bit successfully tracks the verification pulsations of emitter 12, then CPU 17 concludes that the door is in fact closed and returns control to block 31, which reenergizes emitter 12. In the illustrative program of Appendix I the verification loop produces a total of 10 equally spaced pulses over an elapsed time of 15 milliseconds.

Appendix I provides an illustrative assembly-language program listing for microprocessor 15 according to the general flow chart of FIG. 2. In that listing, the function labeled WATCHD, which stands for "watch dog," provides a refresh sequence for the microprocessor hardware when the routine returns to the beginning from block 44. The function labeled WARMPU, which stands for "warm power up," refreshes the sensor-status bit if the apparatus should be instantaneously turned off and on. The other instructions of the listing will be readily interpretable by those skilled in the art of microprocessor programming. It will be appreciated that the listing of Appendix I provides only an illustrative program for implementing the method of the invention, and other programs could be written by one skilled in the art for carrying out the method disclosed herein.

While the above provides a full and complete disclosure of the preferred embodiments of the invention, various modifications and equivalents will occur to those skilled in the art given the benefit of this disclosure. For example, many of the software functions provided by microprocessor 15 could be implemented by well known logic gate arrays external to the microprocessor. Also, other predetermined sequences of pulses of different pulse widths and spacings or even a sequence of randomly generated pulses could be used in the verification loop. All such modifications and alternate constructions are considered to fall within the spirit and scope of the invention disclosed herein, which is defined by the appended claims.

APPENDIX I

```
SL211G; MICROBENCH 8Ø51 CROSS ASSEMBLER (V1)-176 17-AUG-82 1Ø:ØØ:19 DUROPN - CHECK DOOR STATUS

                                SBTTL   DUROPN - CHECK DOOR STATUS
                        ;
                        ;NAME - DOROPN
                        ;
                        ;FUNCTION - CHECK DOOR OPEN INPUT, SEND DOOR OPEN CODE TO CRTC, PULSE
                        ;DOOR INTEROGATE BIT WHEN DOOR IS CLOSED
                        ;
                        ;INPUTS - DOOR
                        ;
                        ;OUTPUTS - DOOR
                        ;
                        ;I/O - DOOR INTEROGATE(DOIN), DOOR OPEN(DIOUT),DOOR OPEN LAMP(DOLMP)
                        ;
                        ;CALLS - XTXDAT, LDELAY, UPCMTR
                        ;
                        ;DESTROYS - A, DPTR
                        ;
                        ;       This routine always exits with DOOR set iff the door is open.
                        ;       DIOUT (the door open LED) is always clear on exit.
                        ;       Note that DIOUT is inverted by hardware.
                        ;       If the door changes from open to closed, and STMODE is clear.
                        ;       we exit with a jump to PWRUP
                        ;       In all other cases, we exit with a RET to the calling routine.
                        ;       This routine does not use a significant number of cycles unless
                        ;       the door is either opening or closing.
                        ;       DOOR is changed from closed to open if DOIN is off for 1ØØ ms.
                        ;       DOOR is changed from open to closed if we pulse DIOUT off and on
                        ;       1Ø times, and DOIN pulses accordingly.
                        ;
3Ø 3ØD2  CØ  Ø2         DOROPN:  PUSH    2                  ;Save R2 in case we destroy it
3Ø 3ØD4  9Ø  362F                MOV     DPTR, #362FH       ;Set up 1ØØ ms. timer
3Ø 3ØD7  2Ø  3B  17     CHKDO;   JB      DOIN, CHDBIT       ;Jump if door appears to be closed
3Ø 3ØDA  2Ø  Ø9  ØD              JB      DOOR, L$           ;Jump if door was and still is open
                                                            ;Door was closed. Is it open now?
3Ø 3ØDD  D5  82  F7              DJNZ    DPL, CHKDO         ;Check for 1ØØ ms.
3Ø 3ØEØ  D5  83  F4              DJNZ    DPH, CHKDO         ;If door is open for 1ØØ ms, then. . .
3Ø 3ØE3  D2  Ø9                  SET3    DOOR               ;Set door open flag
3Ø 3ØE5  74  EØ                  MOV     A, #DOOROP
3Ø 3ØE7  12  2Ø15                CALL    XTXDAT             ;Tell video that the door is open
3Ø 3ØEA  A2  Ø9         L$:      MOV     C, DOOR
3Ø 3ØEC  92  7Ø                  MOV     DOLMP, C           ;Turn on door lamp iff door is open
3Ø 3ØEE  DØ  Ø2                  POP     2                  ;Restore R2
3Ø 3ØFØ  22                      RET
                        ;
3Ø 3ØF1  3Ø  Ø9  F6     CHDBIT:  JNB     DOOR, L$           ;It appears that the door is closed
                                                            ;Return if it was closed all along
3Ø 3ØF4  12  3117                CALL    CHKDOR             ;Pulse DIOUT and see what happens
3Ø 3ØF7  2Ø  Ø9  FØ              JB      DOOR, L$           ;Return if the door didn't really close
3Ø 3ØFA  9Ø  1Ø42                MOV     DPTR, #DOORS       ;The door really has been closed!!
3Ø 3ØFD  12  ØØØØG               CALL    UPCMTR             ;Increment count of door opens
31 31ØØ  2Ø  Ø3  E7              JB      STMODE, L$         ;Just return if in self test mode
31 31Ø3  3Ø  ØA  Ø7              JNB     COMODE, EXDOPN     ;Skip delay unless in coin out mode
31 31Ø6                          LDLAY   1ØØØ               ;Wait one second
31 31ØD                 EXDOPN:  MOVC__  SP, STACK
31 3114  Ø2  2ØBF                JMP     PWRUP              ;Restart everything
                        ;       Pulse the LED 1Ø times to see if the door is really closed
                        ;       CHKDOR is considered part of DOROPN. However, it is
                        ;       called from WARMPU to make sure that DOOR is set correctly.
3 3117   7A  ØA         CHKDOR:  MOV     R2, #1Ø            ;We will decrement R2 until R2 until R2=Ø
3 3119                  1$:      MOVX__  ;Keep the hardware
                                 A,      watchdog happy
                                 WATCHD
3 311D   75  8A  ØØ              MOV     TLØ, #Ø
```

APPENDIX I-continued

SL211G; MICROBENCH 8Ø51 CROSS ASSEMBLER (V1)-176 17-AUG-82 1Ø:ØØ:19 DUROPN - CHECK DOOR STATUS

| | | | | | | | | |
|---|---|---|---|---|---|---|---|---|
| 7 | 312Ø | 75 | 8C | E6 | | MOV | THØ, #ØE6H | ;Roughly 8 ms |
| 8 | 3123 | C2 | 8D | | | CLR | TFØ | |
| 9 | 3125 | D2 | 8C | | | SETB | TRØ | ;Start it running |
| 10 | 3127 | D2 | 5B | | | SETB | DIOUT | ;Turn off LED |
| 11 | 3129 | 2Ø | 8D | 1E | 2$: | JB | TFØ, FAIL | ;Timeout: The door wasn't really closed |
| 12 | 312C | 2Ø | 3B | FA | | JB | DOIN, 2$ | ;Wait until we see the LED turn off |
| 13 | 312F | E4 | | | | CLR | A | |
| 14 | 313Ø | ØØ | | | 3$: | NOP | | ;Make this loop last 1.5 ms |
| 15 | 3131 | 2Ø | 3B | F5 | | JB | DOIN, 2$ | ;Jump if it didn't stay off long enough |
| 16 | 3134 | D5 | EØ | F9 | | DJNZ | ACC, 3$ | |
| 17 | 3137 | C2 | 5B | | | CLR | DIOUT | ;Turn on LED |
| 18 | 3139 | 2Ø | 8D | ØE | 4$: | JB | TFØ, FAIL | ;Timeout: The door wasn't really closed. |
| 19 | 313C | 3Ø | 3B | FA | | JNB | DOIN, 4$ | ;Wait until we see the LED turn on |
| 2Ø | 313F | ØØ | | | 5$: | NOP | | ;Make this loop last 1.5 ms |
| 21 | 314Ø | 3Ø | 3B | F6 | | JNB | DOIN, 4$ | ;Jump if it didn't stay on long enough |
| 22 | 3143 | D5 | EØ | F9 | | DJNZ | ACC, 5$ | |
| 23 | 3146 | DA | D1 | | | DJNZ | R2, 1$ | ;Loop for 1Ø passes |
| 24 | 3148 | C2 | Ø9 | | | CLR | DOOR | ;Tell main program that door is closed |
| 25 | 314A | C2 | BC | | FAIL: | CLR | TRØ | ;Stop the timer |
| 26 | 314C | C2 | 5B | | | CLR | DIOUT | ;Make sure the LED is on for next time |
| 27 | 314E | 22 | | | | RET | | |

What is claimed is:

1. Door interlock apparatus for monitoring the opening and closing of a door comprising:

a radiative emitter and a sensor positioned in operative association with said door so as to communicate with one another across a gap when said door is in closed position;

first means connected to said sensor and having a first state indicating said sensor is receiving radiation and a second state indicating said sensor is not receiving radiation;

second means connected to said emitter and responsive to said first means for interrogating said sensor, said second means causing said emitter to emit a predetermined sequence of a fixed number of pulses only when said first means is in said first state to verify whether said sensor is in communication with said emitter and hence that said door is closed;

third means connected to said sensor and providing a signal whenever said sensor fails to track said predetermined sequences; and fourth means connected to said third means and providing an indication of unauthorized opening of said door in response to said signal.

2. Door interlock apparatus for monitoring the opening and closing of a door comprising:

a radiative emitter and a sensor positioned in operative association with said door so as to communicate with one another across a gap when said door is in closed position;

first means connect to said sensor and having a first state indicating said sensor is receiving radiation and a second state indicating said sensor is not receiving radiation;

second means connected to said emitter and responsive to said first means for interrogating said sensor, said second means causing said emitter to emit at least one pulse when said first means is in said first state to verify whether said sensor is in communication with said emitter and hence that said door is closed;

third means connected to said sensor and providing a signal whenever said sensor fails to track said at least one pulse;

fourth means connected to said third means and providing an indication of unauthorized opening of said door in response to said signal; and fifth means providing an indication that said door is open whenever said first means is in said second state for a predetermined period.

3. The door interlock apparatus of claim 2 wherein said radiative emitter and said sensor operate at different current levels thereby to frustrate attempts to simulate communication of said emitter and sensor by shunting said emitter and sensor together.

4. Door interlock apparatus for monitoring the opening and closing of a door comprising:

a radiative emitter and a sensor positioned in operative association with said door so as to communicate with one another across a gap when said door is in closed position, wherein said emitter and said sensor operate at different current levels thereby to frustrate attempts to simulate communication of said emitter and sensor by shunting said emitter and sensor together;

first means connected to said sensor and having a first state indicating said sensor is receiving radiation;

second means connected to said emitter and responsive to said first means for interrogating said sensor, said second means causing said emitter to emit a predetermined sequence of pulses when said first means is in said first state to verify whether said sensor is in communication with said emitter and hence that said door is closed;

third means connected to said sensor and providing a signal whenever said sensor fails to track said predetermined sequence; and fourth means connected to said third means and providing an indication of unauthorized opening of said door in response to said signal.

5. A method of monitoring the opening of a door, wherein a radiative emitter and a sensor are positioned in operative association with said door to communicate with one another when said door is in closed position, the method comprising the steps of:

monitoring whether radiation to said sensor is continuously interrupted for a predetermined duration;

when radiation to said sensor is continuously interrupted for said duration, providing a first signal for indicating said door is in open position;

when radiation to said sensor is not continuously interrupted for said duration, determining whether said emitter and said sensor are still in communication with one another, and when not still in communication with one another, providing a second signal indicating unauthorized opening of said door; and when said emitter and said sensor are still in communication with one another, repeating the above-named steps.

6. The method of claim 5, further comprising the step of storing in a memory device in response to said second signal an indication that said door was opened.

7. Door interlock apparatus for monitoring entry to the interior of a secured cabinet by monitoring the opening and closing of an access door to said cabinet, the apparatus comprising:

light emitting means and light sensing means for receiving light from said light emitting means, one of said light emitting means and said light sensing means being mounted on said door and the other of said light emitting means and said light sensing means being mounted within said cabinet in position to communicate with said door-mounted means when said door is in closed position;

a microprocessor for verifying whether said door is open or closed, said microprocessor including:

input means responsive to said light sensing means and storing a sensor-status bit indicating whether said light sensing means is sensing light;

a counter responsive to said input means for counting off a predetermined time interval when said sensor-status bit indicates said light sensing means is not sensing light; and output means connected to said light emitting means and providing a pulse control signal for pulsing said light emitting means when said sensor-status bit indicates said light sensing means is sensing light;

first indicator means connected to said microprocessor and providing an indication that said door is open whenever said counter counts off said predetermined time interval; and second indicator means connected to said microprocessor and providing an indication of unauthorized access to said cabinet whenever said sensor-status bit fails to track said pulse control signal for a predetermined sequence of pulses.

8. The door interlock apparatus of claim 7 wherein said light emitting means and said light sensing means operate at different current levels thereby to frustrate attempts to simulate communication of said emitting means and sensing means by shunting said emitting means and said sensing means together.

9. The door interlock apparatus of claim 8, wherein said light emitting means is provided by a light emitting diode.

10. The door interlock means of claim 9, wherein said light sensing means is provided by a phototransistor.

11. A method of monitoring the opening of a door, wherein a radiative emitter and a sensor are positioned in operative association with said door to communicate with one another when said door is in closed position, the method comprising the steps of:

monitoring whether radiation to said sensor is continuously interrupted for a predetermined duration, said monitoring step including the substeps of:

providing an indicative signal whenever said sensor is receiving radiation; and periodically determining over said predetermined duration whether said indicative signal is being provided, whereby failure to detect said indicative signal for the predetermined duration indicates that radiation to said sensor has been interrupted;

when radiation to said sensor is continuously interrupted for said duration, providing a first signal for indicating said door is in open position;

when radiation to said sensor is not continuously interrupted for said duration, determining whether said emitter and said sensor are still in communication with one another; and when said emitter and said sensor are still in communication with one another, repeating the above-named steps.

12. A method of monitoring the opening of door, wherein a radiative emitter and a sensor are positioned in operative association with said door to communicate with one another when said door is in closed position, the method comprising the steps of:

providing a first signal when said sensor is receiving radiation;

causing said emitter to emit a sequence of a fixed number of pulses in response to said first signal;

monitoring whether said sequence is received by said sensor; and providing a second signal to an indicator means when said sensor fails to receive said sequence, thereby indicating that said emitter and said sensor are not in communication with one another, for indicating an attempt to tamper with said door.

13. The method of claim 12, further comprising the step of operating said emitter and said sensor at different current levels, thereby to make said emitter and sensor inoperative when shunted together.

14. The method of claim 12, wherein said emitter is caused to emit said fixed number of pulses in a random sequence.

15. The method of claim 12, wherein said emitter is caused to emit said fixed number of pulses in a predetermined sequence.

* * * * *